US007402082B2

(12) United States Patent
Zhang

(10) Patent No.: US 7,402,082 B2
(45) Date of Patent: Jul. 22, 2008

(54) ELECTRICAL CONNECTOR WITH RETAINING SHELL

(75) Inventor: Han-Ming Zhang, ShenZhen (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/894,882

(22) Filed: Aug. 22, 2007

(65) Prior Publication Data

US 2008/0050941 A1 Feb. 28, 2008

(30) Foreign Application Priority Data

Aug. 22, 2006 (CN) ..... 2006 2 0075646

(51) Int. Cl.
*H01R 13/648* (2006.01)

(52) U.S. Cl. ..... 439/607; 439/330; 439/73

(58) Field of Classification Search ..... 439/71, 439/73, 330, 607

See application file for complete search history.

(56) References Cited

U.S. PATENT DOCUMENTS 7,223,125 B2 * 5/2007 Chen ..... 439/609
2007/0238357 A1 * 10/2007 Wang ..... 439/607

* cited by examiner

*Primary Examiner*—Tho D Ta
(74) *Attorney, Agent, or Firm*—Wei Te Chung

(57) ABSTRACT

An electrical connector adapted for connecting a camera module to a printed circuit board via a flexible printed circuit comprises a shield and a spring plate. The shield includes a pair of opposite rear and front walls, a pair of left and right walls adjacent to the rear and front walls, and a flat bottom wall connecting the walls together to enclose a cavity for receiving the camera module. The spring plate is mounted on the bottom wall of the shell and has a main portion and a number of elastic arms extending outward from the two opposite sides of the main portion. Each of the front and rear wall of the shield includes an upright base extending upwardly from the bottom wall, a retaining section extending upwardly from the center of the upright base, and a pair of fastening sections extending from both sides of the retaining section and bending toward the receiving cavity.

5 Claims, 3 Drawing Sheets

ELECTRICAL CONNECTOR WITH RETAINING SHELL

BACKGROUND OF THE INVENTION

1. Field of the Invention

The present invention relates to an electrical connector, and more particularly to an electrical connector adapted for connecting a camera module to a printed circuit board via a flexible printed circuit.

2. Description of the Related Art

Referring to FIG. 3, a conventional electrical connector 1' for fastening a component, such as a camera module 2' in an electrical device (not shown), comprises a metal shield 10' and an insulating housing 20' with a plurality of contacts 30'. The shield 10' has four sidewalls 11' and the housing 20' has an elongate base connected to the bottom end of two opposite sidewalls 11' to form a receiving cavity 12' together with the four sidewalls 11'. Several fastening members 13' are formed on sidewalls 11' and extend inward to the receiving cavity 12' for fastening the module 2'.

However, the fastening structure of the connector 1' is not firm because the fastening members 13' are easy to deflect, and thus the module 2' is likely to drop out of the connector 1' due to external impact or the like.

Hence, an improved electrical connector is desired to overcome the above problems.

BRIEF SUMMARY OF THE INVENTION

It is an object of the present invention to provide an electrical connector which easily and securely receives a module body therein.

In order to obtain the objective above, an electrical connector adapted for connecting a camera module to a printed circuit board via a flexible printed circuit comprises a shield and a spring plate. The shield includes a pair of opposite rear and front walls, a pair of left and right walls adjacent to the rear and front walls, and a flat bottom wall connecting the walls together to enclose a cavity for receiving the camera module. The spring plate is mounted on the bottom wall of the shell and has a main portion and a number of elastic arms extending outward from the two opposite sides of the main portion. Each of the front and rear wall of the shield includes an upright base extending upwardly from the bottom wall, a retaining section extending upwardly from the center of the upright base, and a pair of fastening sections extending from both sides of the retaining section and bending toward the receiving cavity.

Other objects, advantages and novel features of the invention will become more apparent from the following detailed description of the present embodiment when taken in conjunction with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE INVENTION

Figure 1:
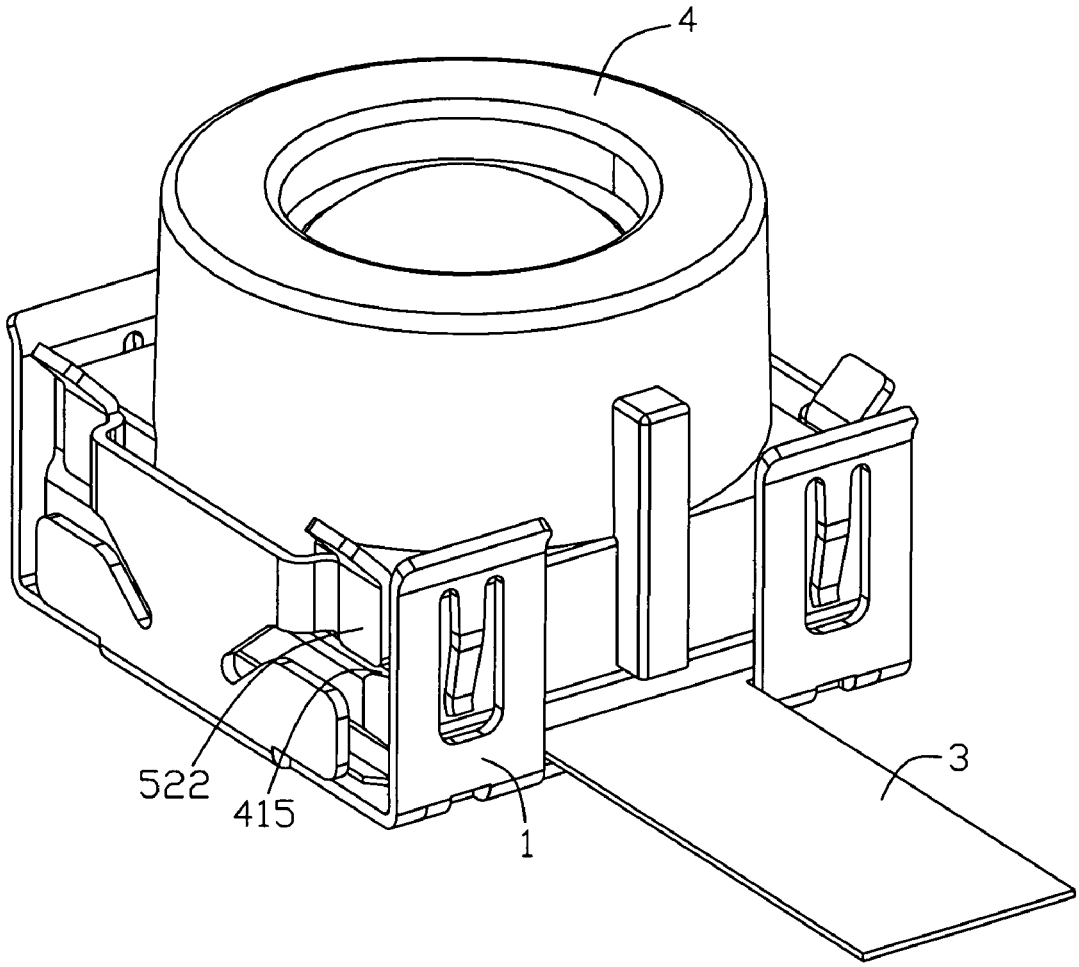
FIG. 1 is a perspective view of the electrical connector of the present invention with a module body and a flexible printed circuit received therein.

In the following detailed description, for purposes of explanation, numerous specific details are set forth in order to provide a thorough understanding of the present invention. It will be apparent, however, that the present invention may be practiced without these specific details. In other instances, well-known structures and devices are schematically shown in order to simplify the drawing.

An electrical connector according to the present invention is applicable to electronic apparatuses such as digital cameras, PDAs (Personal Digital Assists), PCs (Personal Computers), mobile telephones or the like. In the preferred embodiment illustrated in FIGS. 1-2, the electrical connector 1 is used in a mobile handset (not shown) for connecting a camera module 4 (an electrical element) to an internal PCB (not shown) via a flexible printed circuit.

Figure 2:
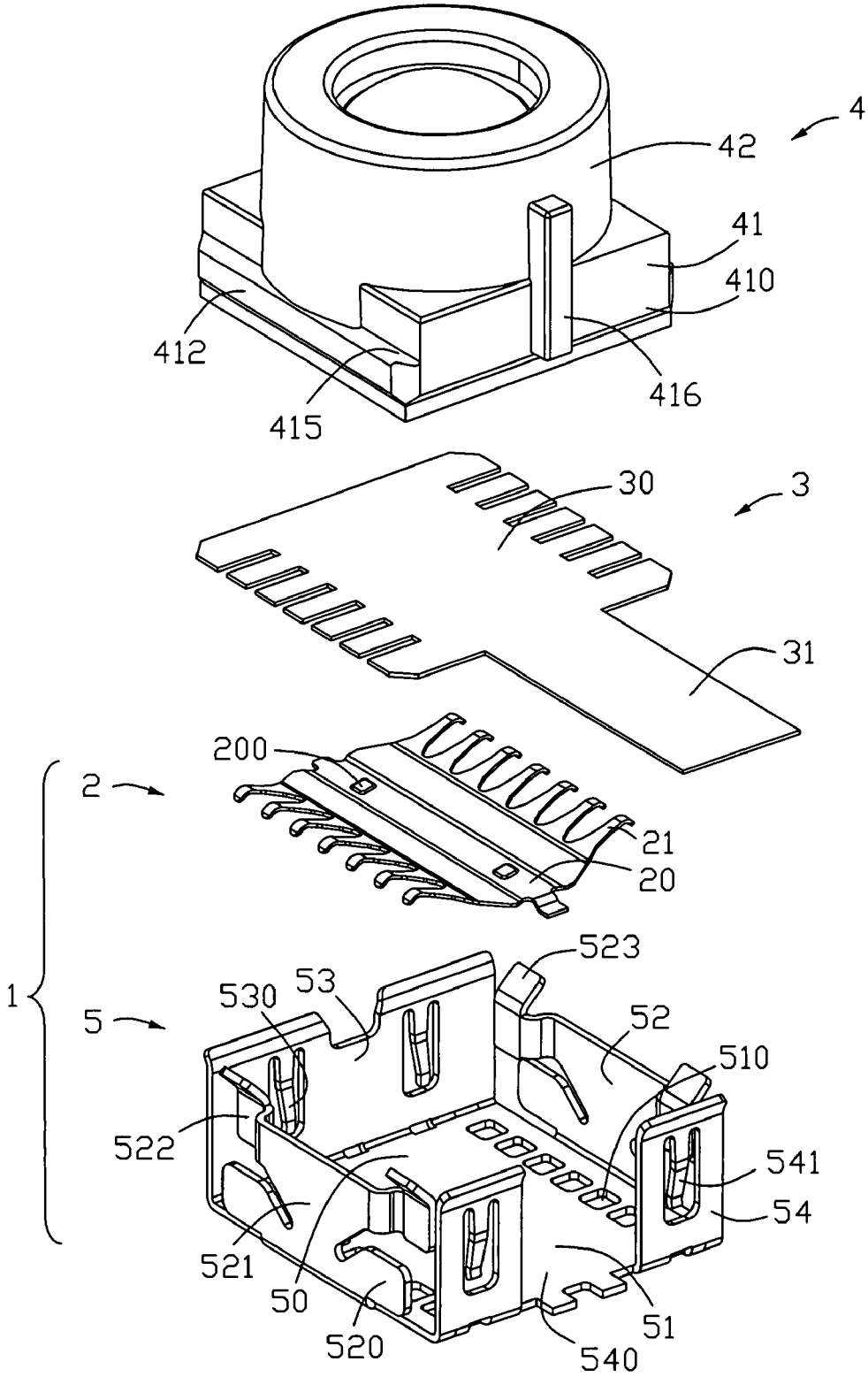
FIG. 2 is an exploded view of the electrical connector with the module body and the flexible printed circuit shown in FIG. 1.
Figure 3:
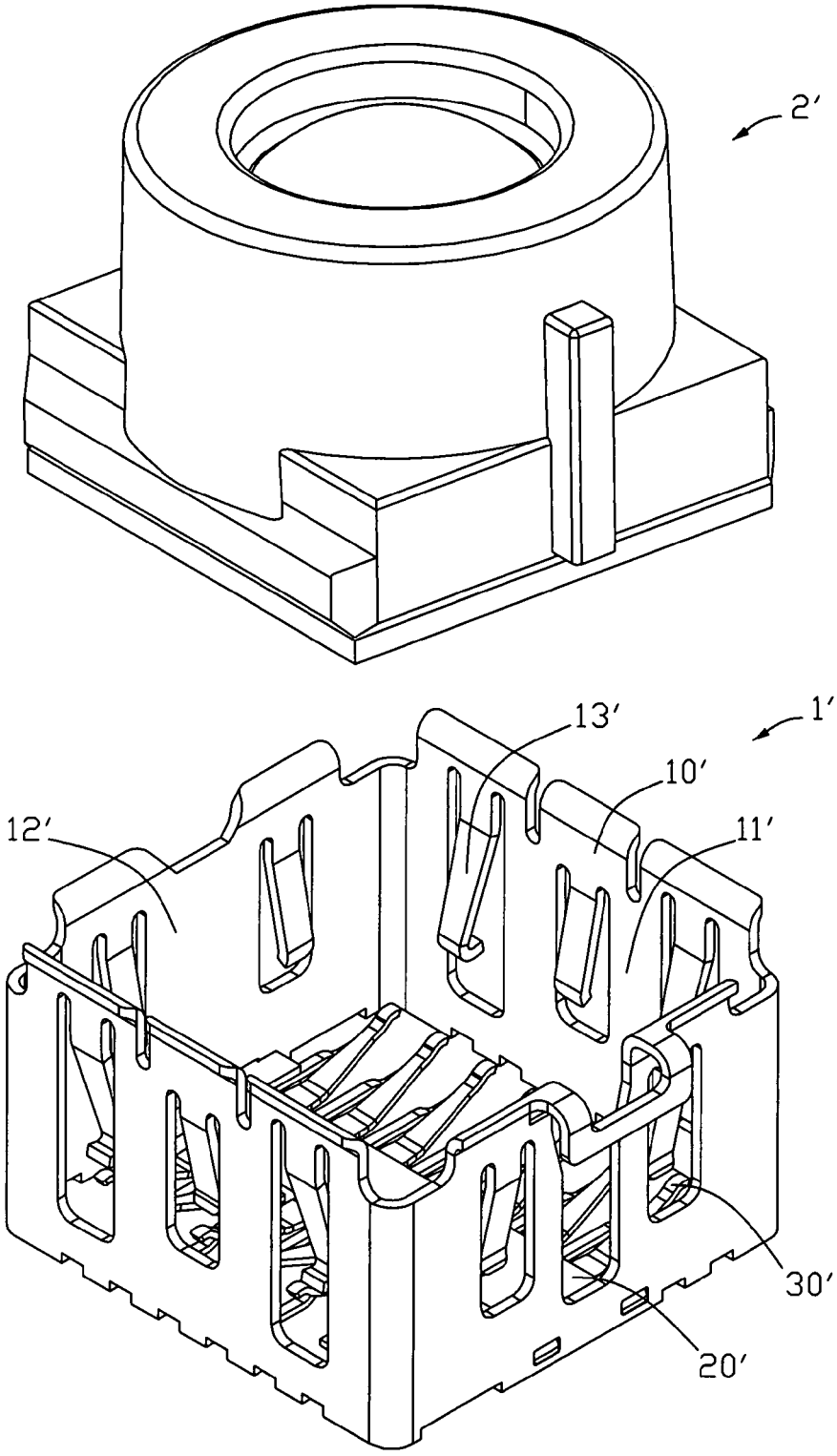
(RELATED ART) FIG. 3
FIG. 3 is a perspective view of an electrical connector with the module body of the related art.

FIG. 2 is an exploded perspective view of the electrical connector for receiving a camera module in the embodiment of this invention. In the figure, the reference numeral 5 denotes a shielding shell made of a metal material. The reference numeral 2 denotes a spring plate made of metal sheet and assembled on the bottom wall of the shell 5.

The shell 5 is made of metal material and is in configuration of a frame. The shell 5 defines a cavity 50 upwardly open and includes a pair of opposite rear and front walls 52, a pair of left and right walls 53, 54 adjacent to the rear and front walls 52, and a flat bottom wall 51 connecting the walls 52, 53, 54. The walls 52, 53, 54 and the bottom wall 51 together enclose the cavity 50 as a receiving section to receive the camera module 4 therein.

A window 540 is provided on the right wall 54 for passing through by the flexible printed circuit 3. A plurality of retaining spring pieces 541, 530 are formed on the left and right walls 54, 53, respectively, and extend inward to the cavity 50 to contact with the camera module 4. Each of the front and rear walls 52 includes an upright base 520 extending upwardly from the bottom wall 51, a retaining section 521 extending upwardly from the center of the upright base 520, and a pair of fastening section 522 extending from both sides of the retaining section 521 and bending toward the receiving cavity 50. The top end of the fastening section 522 defines a chamfer 523 outward the cavity 50 in order to lead the camera module 4 into the cavity 50.

As shown in FIG. 2, the spring plate 2 is formed from a metal sheet and mounted on the bottom wall 51 of the shell 5. Said spring plate 2 is in a configuration of fishbone and comprises a main portion 20 extending along the longitudinal direction and against the bottom wall 51 of the shell 5 and a plurality of elastic arms 21 extending outward from the two opposite sides of the main portion 20. A plurality of openings 510 is formed on the bottom wall 51 of the shell 5 corresponding to the elastic arms 21. When the spring plate 2 is pressed, the elastic arms 21 undergo an elastic displacement and may run into the openings 510 provided for increasing the active space of the spring plate 2. At least one protrusion 200 is formed on the top surface of the main portion 300 for contacting with the flexible printed circuit 3 and stopping the camera module 4 from further moving downwardly.

The flexible printed circuit 3 between the camera module 4 and the spring plate 2 comprises a first section 30 received in the cavity 50 of the shell 5 and a second section 31 extending outward from the window 540 of the shell. The top surface of the first section 30 defines a plurality of conductive elements so as to contact with the camera module 4 for electrical connecting the camera module 4 to the printed circuit board (not shown).

The electrical element employed in this embodiment is the camera module 4, but it need not be so limited. The camera module 4 comprises a base portion 41 and a columnar portion 42 extending upwardly from the base 41. The base portion 41 includes a front wall 410, a pair of opposite adjacent walls 412 and a back wall opposite to the front wall 410. A pair of step engaging portions 415 is defined at the walls 412 corresponding to the fastening sections 522 of the shield 5. The camera module also has a projecting portion 416 upwardly and laterally extending from a central portion of the front wall 410. The projecting portion 416 extends upwardly until it reaches a half height of the columnar portion 42, and combines with the columnar portion 42.

Referring to FIGS. 1-2, in assembling the electrical connector 1, the spring plate 2, the flexible printed circuit 3, and the camera module 4 are received in the cavity 50 in turn. When the camera module 4 is guided in, the projecting portion 416 should be placed in the window 540, and the fastening sections 522 of the shield 5 engage with the corresponding engaging portions 415 to fasten the module 4 in the cavity 50. Further moving the module downwardly, the retaining spring pieces 530, 541 of the left and right walls 53, 54 will deform by the action of the camera module 3. The first section 30 of the flexible printed circuit 3 is received in the cavity 50 of the shell 5 and the top and the bottom surfaces of the first section 30 are contacted with the bottom of the camera module 3 and the elastic arms 21 of the spring plate, and the second section 31 of the flexible printed circuit board 3 extends outwardly of the shell 10 via the window 540.

In the detailed description of this invention, the fastening sections 522 of the shield engage with the corresponding engaging portions 415 of the module 4, thus the module 4 is locked in the cavity firmly.

It is to be understood, however, that even though numerous, characteristics and advantages of the present invention have been set fourth in the foregoing description, together with details of the structure and function of the invention, the disclosed is illustrative only, and changes may be made in detail, especially in matters of number, shape, size, and arrangement of parts within the principles of the invention to the full extent indicated by the broad general meaning of the terms in which the appended claims are expressed.

What is claimed is:

1. An electrical connector adapted for connecting a camera module to a printed circuit board via a flexible printed circuit, comprising:

a shield including a pair of opposite rear and front walls, a pair of left and right walls adjacent to the rear and front walls, and a flat bottom wall connecting the walls together to enclose a cavity for receiving the camera module, a spring plate mounted on the bottom wall of the shell and having a main portion extending and a plurality of elastic arms extending outward from the two opposite sides of the main portion, and each of the front and rear walls of the shield including an upright base extending upwardly from the bottom wall, a retaining section extending upwardly from the center of the upright base, and a pair of fastening sections extending from both sides of the retaining section and bending toward the receiving cavity;

wherein a window is provided on the right wall for passing through by the flexible printed circuit;

wherein a plurality of retaining spring pieces are formed on the left and right walls, respectively, and extend inward to the cavity to contact with the camera module.

2. The electrical connector according to claim 1, wherein at least one protrusion is formed on the top surface of the main portion.

3. The electrical connector according to claim 1, wherein the top end of the fastening section defines a chamfer to lead the camera module into the cavity.

4. The electrical connector according to claim 3, wherein a plurality of openings is formed on the bottom wall of the shield corresponding to the elastic arms.

5. An electrical connector comprising:

a metallic shell including a bottom wall, a pair of opposite rear and front walls and a pair of left and right walls commonly defining a receiving cavity;

a flexible printed circuit disposed in said receiving cavity and extending out of said receiving cavity via an opening formed in said right wall;

a retention structure formed on each of the front and rear walls, and including:

a pair of fastening sections respectively located around two opposite ends and invading the receiving cavity, said fastening sections defining a lower downward abutment face and an upper operation face under a condition that said fastening section is essentially deflectable outwardly about a pivotal axis which is perpendicular to the bottom wall;

wherein a plurality of retaining spring pieces are formed on the left and right walls, respectively, and extend inward to the cavity to contact with a camera module.

* * * * *